US008701947B2

(12) United States Patent
Weyts

(10) Patent No.: US 8,701,947 B2
(45) Date of Patent: Apr. 22, 2014

(54) EASY-TO-USE CONICAL CONTAINER

(75) Inventor: Pieter Weyts, New York, NY (US)

(73) Assignee: Pinar Holdings LLC, Miami Beach, FL (US)

( * ) Notice: Subject to any disclaimer, the term of this patent is extended or adjusted under 35 U.S.C. 154(b) by 1167 days.

(21) Appl. No.: 12/104,219

(22) Filed: Apr. 16, 2008

(65) Prior Publication Data

US 2008/0210716 A1 Sep. 4, 2008

Related U.S. Application Data

(63) Continuation-in-part of application No. 11/506,384, filed on Aug. 18, 2006, now abandoned, which is a continuation-in-part of application No. PCT/US2005/002405, filed on Jan. 25, 2005, which is a continuation of application No. 10/782,218, filed on Feb. 19, 2004, now Pat. No. 7,073,692.

(51) Int. Cl.
*B65D 47/10* (2006.01)

(52) U.S. Cl.
USPC ..... 222/541.9; 222/215

(58) Field of Classification Search
USPC ..... 222/541.9, 541.5, 541.692, 215, 206, 222/207, 541.1, 541.6, 92; 383/104, 383/200–206
See application file for complete search history.

(56) References Cited

U.S. PATENT DOCUMENTS

| | | | | |
|---|---|---|---|---|
| 978,843 | A | 12/1910 | Burns | |
| 1,294,011 | A | 2/1919 | Williams | |
| 1,347,231 | A * | 7/1920 | Rothermel | 222/107 |
| 1,438,487 | A | 12/1922 | Greene | |
| 1,817,732 | A | 8/1931 | Boruss | |
| 2,099,412 | A | 11/1937 | Seidler | |
| 2,103,389 | A | 12/1937 | Salfisberg | |
| 2,134,927 | A * | 11/1938 | Pepplatt | 222/482 |
| 2,207,003 | A * | 7/1940 | Dunlap | 229/4.5 |
| 2,248,266 | A | 7/1941 | Abrams | |
| 2,283,102 | A * | 5/1942 | Stephano | 206/264 |
| 2,517,027 | A | 8/1950 | Rado | |
| 3,009,498 | A | 11/1961 | Fohr | |
| 3,172,796 | A | 3/1965 | Gulker | |
| 3,184,121 | A | 5/1965 | Volckening | |
| 3,278,085 | A | 10/1966 | Brown | |
| 3,438,567 | A | 4/1969 | Bell, Jr. | |
| 3,635,376 | A | 1/1972 | Hellstrom | |
| 3,741,384 | A | 6/1973 | Cloud | |
| 4,759,472 | A | 7/1988 | Strenger | |
| 4,872,571 | A * | 10/1989 | Crecelius et al. | 222/541.1 |
| D308,019 | S | 5/1990 | Mileos | |
| 4,928,852 | A | 5/1990 | Guiffray | |
| 4,949,857 | A | 8/1990 | Russell | |
| 5,018,646 | A | 5/1991 | Billman et al. | |
| 5,156,286 | A * | 10/1992 | Piccard | 215/232 |
| D333,785 | S | 3/1993 | Ohlsson et al. | |
| 5,353,968 | A | 10/1994 | Good | |
| 5,411,178 | A | 5/1995 | Roders et al. | |

(Continued)

FOREIGN PATENT DOCUMENTS

| | | |
|---|---|---|
| DE | 1056953 | 8/1957 |
| NL | 9401377 | 4/1996 |
| WO | WO87/00819 | 2/1987 |
| WO | WO92/12070 | 7/1992 |

*Primary Examiner* — Lien Ngo
(74) *Attorney, Agent, or Firm* — Cooper & Dunham LLP

(57) ABSTRACT

A container and dispenser in conical shape for edible or non-edible substances is described.

22 Claims, 20 Drawing Sheets

(56) References Cited

U.S. PATENT DOCUMENTS

| | | | |
|---|---|---|---|
| 5,577,636 | A | 11/1996 | Fukuoka et al. |
| 5,676,990 | A | 10/1997 | Wawrzynski |
| D396,634 | S | 8/1998 | Andren et al. |
| 5,839,609 | A | 11/1998 | Zakensberg |
| D402,197 | S | 12/1998 | Poulin |
| 6,241,132 | B1 | 6/2001 | Morrison |
| 6,244,467 | B1 | 6/2001 | Lewis |
| 6,267,507 | B1 | 7/2001 | de Laforcade |
| 6,581,764 | B1 | 6/2003 | Hillebrand |
| 6,702,462 | B2 | 3/2004 | Richardson |
| 6,874,665 | B2 | 4/2005 | Doherty et al. |
| 7,073,692 | B2 | 7/2006 | Weyts |
| 2001/0042757 | A1 | 11/2001 | Kuge et al. |
| 2002/0127308 | A1 | 9/2002 | Suzuki et al. |

* cited by examiner

Fig. 6C
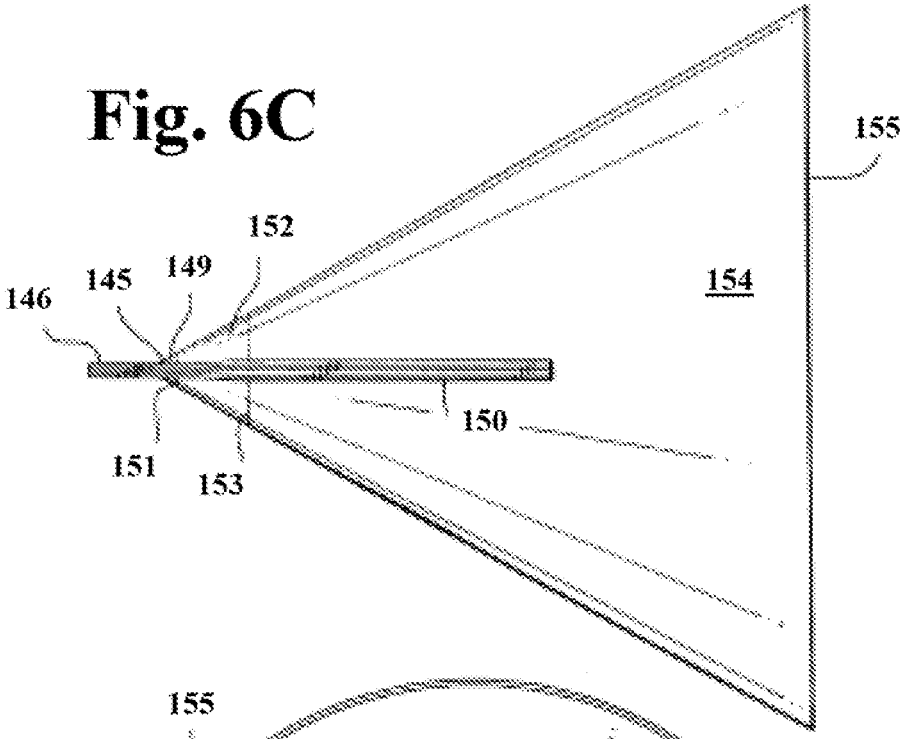
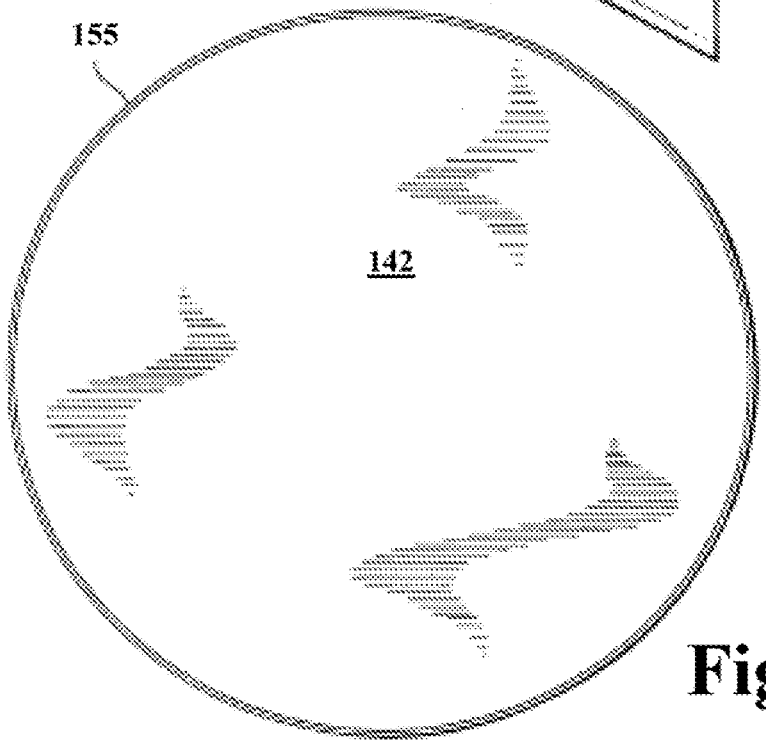
Fig. 6D

FIG. 14
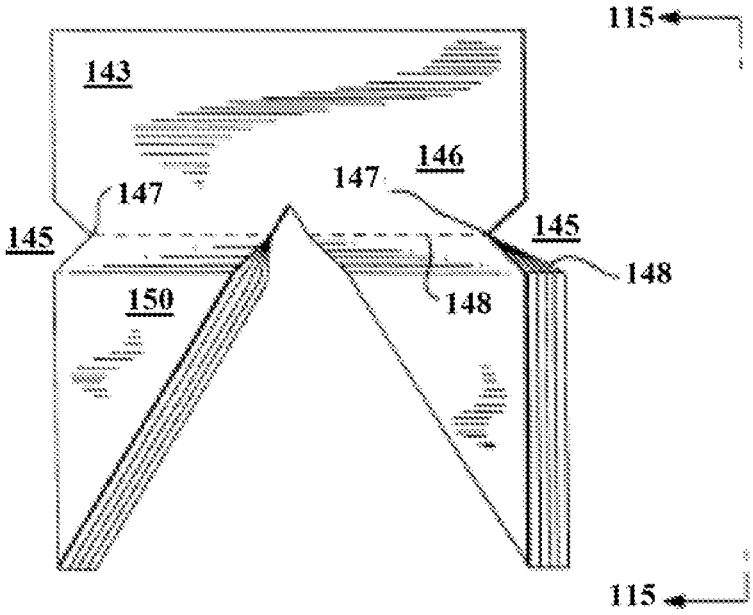
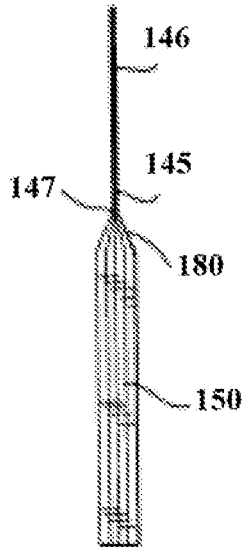
FIG. 15

EASY-TO-USE CONICAL CONTAINER

CROSS-REFERENCE TO RELATED APPLICATIONS

This application is a continuation-in-part of Ser. No. 11/506,384, filed Aug. 18, 2006 now abandoned, which in turn is a continuation-in-part of International application no. PCT/US2005/002405, filed Jan. 25, 2005, which claims the priority of U.S. application Ser. No. 10/782,218, filed Feb. 19, 2004, now U.S. Pat. No. 7,073,692, issued Jul. 11, 2006, the entire contents of each of which are incorporated herein by reference.

TECHNICAL FIELD

The present disclosure is generally directed to a novel device for holding and dispensing edibles or non-edible substances, in a measured and precise manner, where such devices can be easily and conveniently opened without the need for a knife, scissors or other utensil, and easily resealed.

BACKGROUND

In numerous instances of use or consumption of liquid or semi-liquid substances, there is a need for a dispenser that allows the substance to be applied in a measured and precise manner. For example, a person eating french fries may want to dispense a small portion of ketchup on the fries; a person eating a bagel, roll or another type of bread may want to use a small portion of spread-able cheese, jam, or chocolate paste; a person eating a salad may want a small portion of salad dressing; a hotel guest may require a small portion of shampoo or soap for an overnight stay. In all these instances, consumers want to be able to apply the substance where they want it, and in the volume they want it.

In general, a container, like any consumer product, is preferably easy and convenient to use, especially when containers of relatively small portions are involved. When the portion to be consumed is relatively small, people do not want to encounter too many practical obstacles in opening the container and dispensing the small portion. Consumers typically want the small portions to be easily dispensable without spending much time opening the container or ensuring that the content be dispensed in a proper and accurate manner.

Many conventional containers require a tool or utensil for opening the container or dispensing the content of the container. For example, a container may require a knife or other device for opening the container, or a fork or spoon to dispense the substance of the container. The need for a tool or utensil makes the container cumbersome to use thereby greatly diminishing its practicality and attractiveness to consumers. Again this is particularly true for containers and dispensers of small portions, where the small size of the content to be dispensed may not justify the extra burden of effort or time of using a tool or utensil. The use of a tool or utensil to open the container or dispense its content generally involves an investment of time and effort that consumers generally prefer not to expend, if they had a choice. Consumers typically prefer a container that can be opened and used without the need for a utensil or other device.

When consumers use a dispenser, they do not necessarily want to consume all of the contents of the dispenser. Therefore, consumers prefer a dispenser that can be easily re-sealed which allows them to consume the remainder of the contents of the dispenser at a later time.

In addition, it is preferable that the dispenser be easy and relatively cheap to manufacture.

There remains a need for a dispenser or container of fluid or semi-fluid substances which a) allows the substance to be applied in a measured and precise manner, b) is easy and convenient to use, c) can be opened and used without the need for a utensil or other device, d) can be easily resealed, and e) is simple and economical to manufacture. The terms "container" and "dispenser" are used herein interchangeably.

BRIEF SUMMARY

The present disclosure is directed to a container and dispenser having a conical shape and to a method of manufacturing such container for dispensing liquids or semi-liquids. The container is constructed of collapsible, waterproof material, and the edible or non-edible substance is completely enclosed and sealed within the dispenser. A tab is attached to the tip of the cone and the cone can be opened by removing the tab. After the user has removed the tab from the tip of the dispenser, an opening is created in the tip of the cone and the user can easily dispense the substance in a precise and measured manner by pressing the collapsible walls or back of the dispenser without the need for a knife, scissors or other utensil.

In an exemplary embodiment of the disclosure, there is a zone of weakness where the tab is attached to the tip of the cone to allow the tab to be torn off the tip of the cone with great ease. The tip of the cone may be made of tin foil or similar material which makes the tip of the cone easily re-sealable, after the tab has been removed, by simply pressing together the walls of the tip of the cone.

In another exemplary embodiment, a cap is built into the tab and the cone can be opened by removing the cap from the tip of the cone and can be re-sealed by pressing the cap on the tip of the cone.

In yet another exemplary embodiment, the tab is flexible and in certain parts lightly pasted along the sidewalls of the cone from which it can be easily removed by pulling the tab.

BRIEF DESCRIPTION OF THE DRAWINGS

The features of the subject matter of the present disclosure can be more readily understood from the following detailed description with reference to the accompanying drawings wherein:

FIG. 6C shows a perpendicular view of the exemplary embodiment of FIG. 5 taken approximately along the line 104-104 of FIG. 5;

FIG. 6D shows a frontal view of the exemplary embodiment of FIG. 5 taken approximately along the line 105-105 of FIG. 5;

FIGS. 14, 16, 17, 18 and 19 show different exemplary embodiments of a tab before it has been attached to the sidewalls;

FIG. 15 shows a side view of the exemplary embodiment of FIG. 14, taken approximately along the line 115-115 of FIG. 14;

DETAILED DESCRIPTION OF PREFERRED EMBODIMENTS

Figure 1:
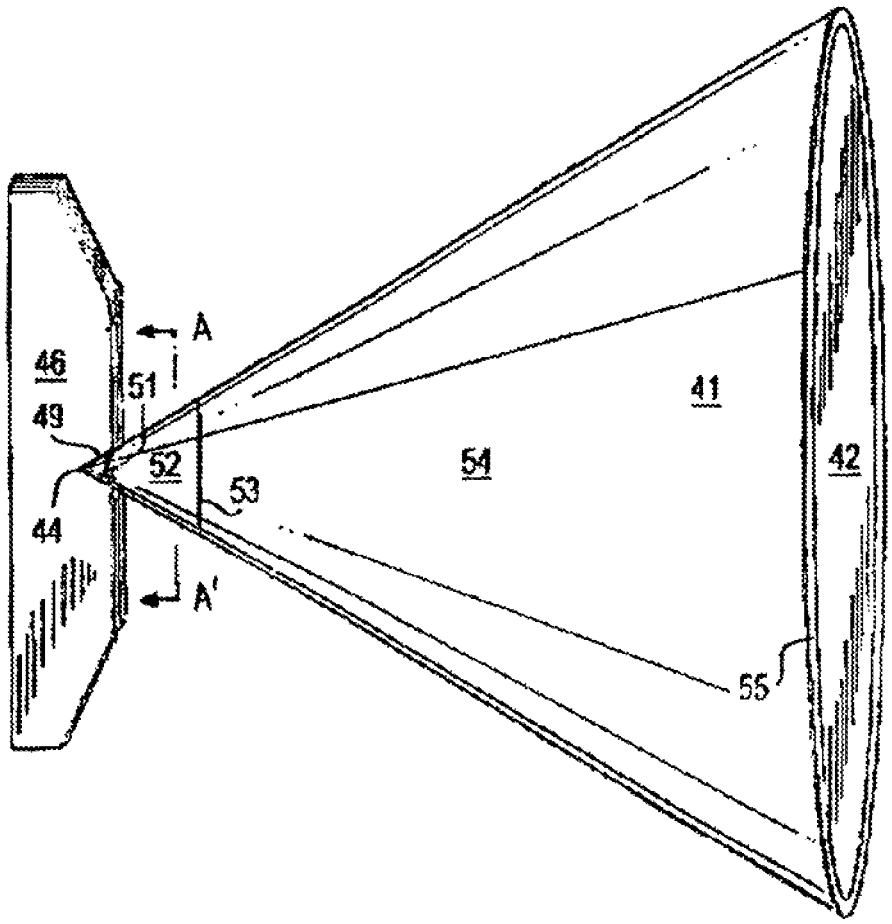
FIG. 1 shows a container and dispenser, according to an exemplary embodiment of the present disclosure, wherein there is a zone of weakness at the location where the tab is attached to the tip of the cone to allow the tab to be torn off the tip of the cone with great ease.

Reference is made below to preferred embodiments of the disclosure, examples of which are also provided in the following description. In describing examples and preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, a conical-shaped dispenser according to an exemplary embodiment is shown in FIG. 1 in a horizontal position including the following main components: sidewalls 41 of the cone; back (or base) 42 of the cone; and tab 46. Both the back (or base) 42 and the sidewalls 41 of the cone can be made of collapsible, waterproof material (such as plastic, tin foil, etc.). The tab 46 is flat and intersects with the cone at the top region 49 of the cone and is used to open the dispenser at the top region 49 of the cone. To start tearing off the tab 46, a user of the dispenser may hold the dispenser by keeping the sidewalls 41 of the cone between index and thumb of one hand, while holding the tab between index and thumb of the other hand, and start moving the two hands in opposite directions, focusing the force at a region where the top region 49 joins with the tab 46. As the force is applied, the top region 49 tears away from the rest of the cone.

In a preferred embodiment, the collapsible walls 41 of the cone can be made of a combination of three different materials creating three separate regions in the walls of the cone. First, the top region 49 of the cone runs from the tip 44 of the cone until an upper dividing line 51. Second, a region 52 of the cone runs from the upper dividing line 51 until a lower dividing line 53, which is located between the upper dividing line 51 and border 55 where the back 42 (which is circular in the exemplary embodiment of FIG. 1) of the cone is attached to the sidewalls 41 of the cone 41. Third, the lower region 54 of the cone runs from the lower dividing line 53 to the border 55 (which is circular in the exemplary embodiment of FIG. 1).

Still referring to FIG. 1, the upper dividing line 51 is in line with the location where the lower part of the tab 46 joins with the top region 49 of the cone. In order to facilitate the tearing movement by the user and the removal of the top region 49 of the cone, the dividing line 51 may be slightly indented or perforated, creating a zone of weakness. Also, the top region 49 of the cone may be made of a weaker material than the middle region 52 of the cone, thereby further facilitating the removal of the top region 49 of the cone when the user makes the tearing movement along the dividing line 51. It should be understood that in other embodiments of the dispenser, a zone of weakness can be created at the dividing line 51 or in which the tearing off of the top region 49 at the dividing line 51 can be facilitated in any of many other different ways in order to optimize the functionality and user-friendliness of the dispenser.

When the user has removed the top region 49 of the cone and the tab 46, the user is left with the middle region 52 of the cone and the lower region 54 of the cone, and the user has effectively and easily opened a passageway for the substance to leave the dispenser at the new tip of the dispenser which is the remaining part of the dividing line 51.

Figure 2:
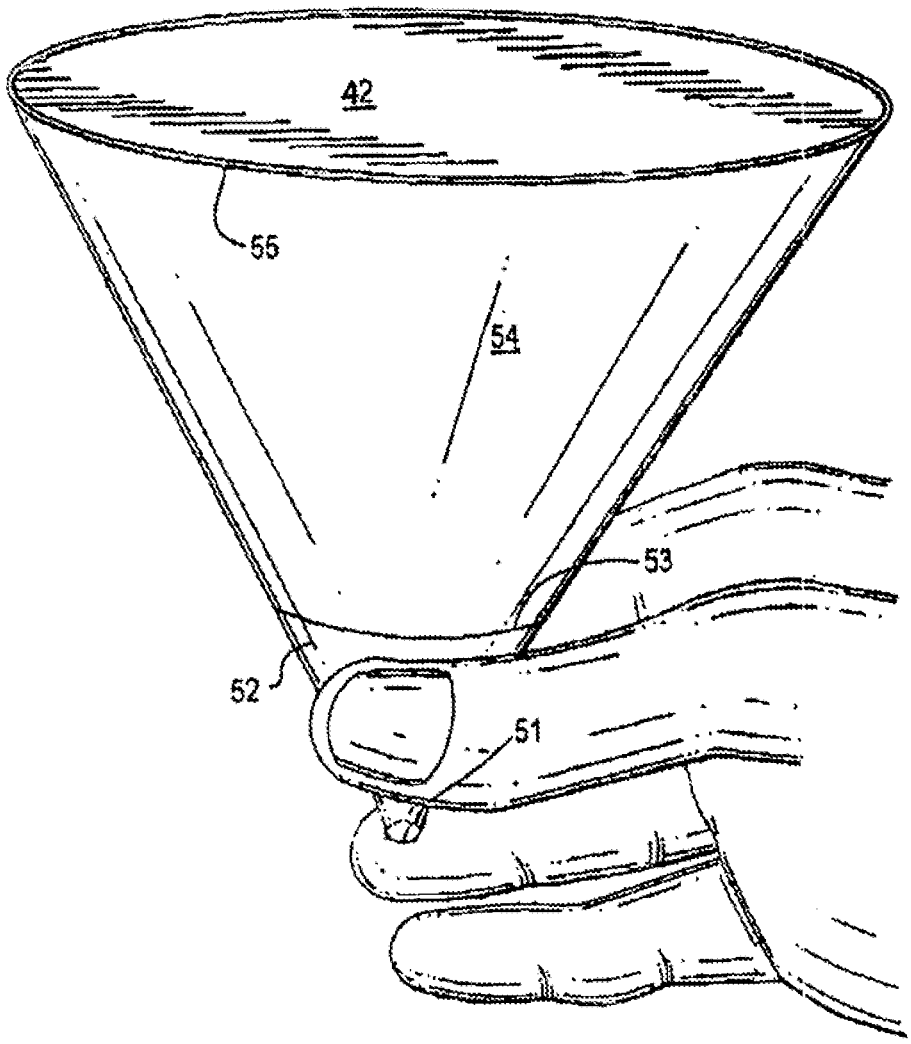
FIG. 2 shows the container and dispenser of FIG. 1 after the tab has been removed from the tip of the cone. The tip of the cone may be made in tin foil or similar material which makes the tip of the cone easily re-sealable, after the tab has been removed, by simply pressing together the walls of the tip of the cone.

FIG. 2 shows the dispenser after the top region 49 of the cone and the tab 46 have been removed. The user can now dispense the substance which is inside the cone in a precise manner by pointing the new tip 51 of the dispenser to the spot where the substance is to be dispensed. Also, the user can now dispense the substance of the cone in a measured manner by more or less pressing the collapsible walls of the middle region 52 or the lower region 54 or the back 42 of the cone.

Still referring to FIG. 2, in the preferred embodiment, the middle region 52 of the collapsible walls of the dispenser can be made of a material such as tin foil, aluminum foil, etc. After the user has opened the dispenser, in the manner described above, and has used it to dispense some of the substance inside the cone, there is spare space available within the dispenser. The user can use this spare space to press the walls of the middle region 52 against each other, particularly at or near the new tip 51 of the dispenser, where the cone is not as wide yet. By pressing together the walls of the middle region in tin foil, the user can in effect re-seal the dispenser as it closes off the tip of the cone hermetically. It should be understood by those skilled in the art that the sealing effect may also be achieved by other materials than tin foil. Once the cone is resealed, the user can store the cone for use at a later time while keeping the substance of the cone in good, non-oxidated condition.

Figure 3:
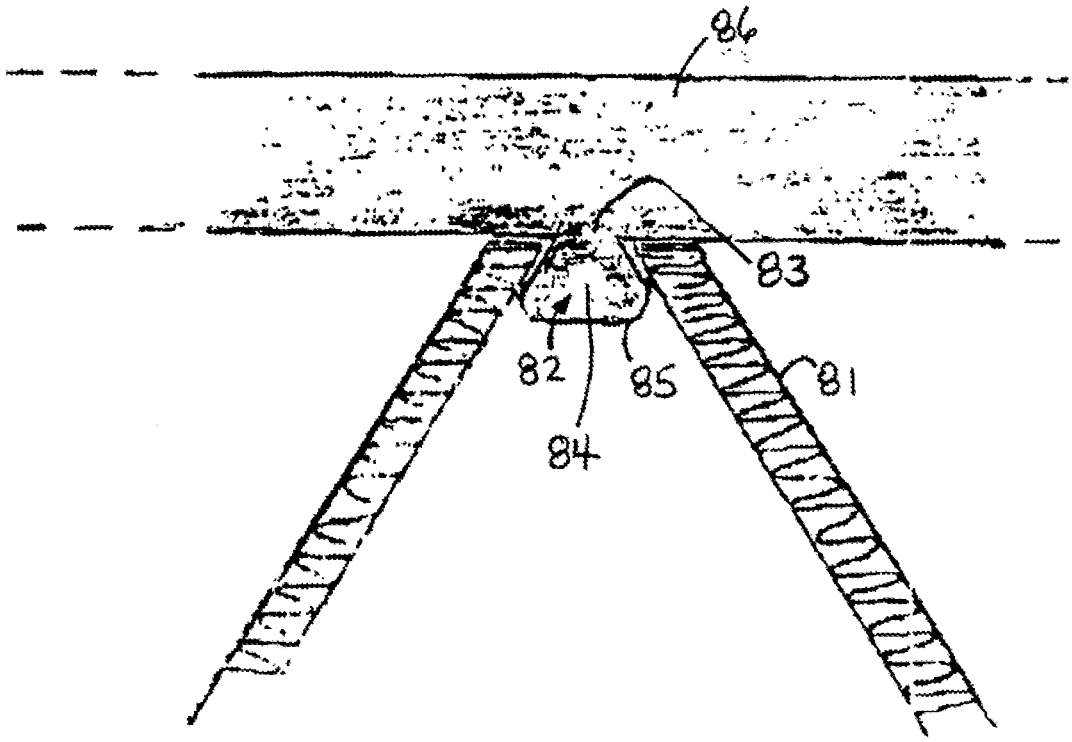
FIG. 3 shows a cross-sectional view of a container and dispenser, according to another embodiment, wherein a cap is enclosed in the tab and the cone can be opened by removing the cap from the tip of the cone and re-sealed by pressing the cap on the tip of the cone.

FIG. 3 shows an expanded, detailed cross-sectional view of a container and dispenser, according to another embodiment taken approximately along the line A-A' of FIG. 1. The container and dispenser of FIG. 3 includes tab 86, a cap 82 which is enclosed in the tab 86 and the walls 81 of the cone. In this embodiment, the walls of the middle region are not collapsible and the cap 82 is held firm between these walls. The cap 82 is flexible so that sidewalls 84 of the cap 82 can bend to enable the lower side 85 of the cap to be squeezed through the narrower opening 83 of the cone when the user of the dispenser pulls the tab 86. After the user has opened the dispenser by pulling the cap 82, the user can start using the dispenser. After the user has used the dispenser, the user can reseal the dispenser by pressing the tab 86 with the enclosed cap again on the dispenser.

It should be understood that other embodiments of the cap 82 are possible such as the addition of a holder of the cap in which the cap 82 can be held. The holder of the cap can be attached to the walls of the middle region and obviates a requirement that the walls not be collapsible.

Figure 4:
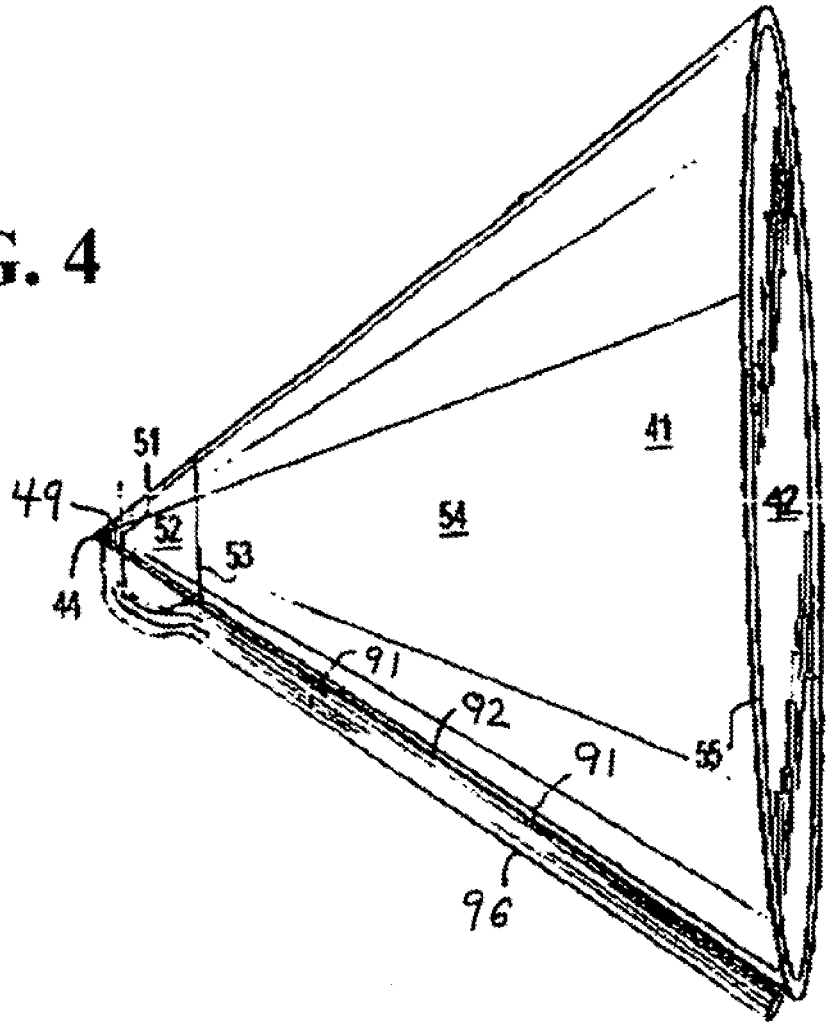
FIG. 4 shows a container and dispenser, according to another embodiment, wherein the tab is flexible and in certain parts lightly pasted to and along the sidewalls of the cone from which it can be easily removed by pulling the tab.

FIG. 4 shows a container and dispenser according to an embodiment in which tab 96 is flexible and at least one side of the tab 96 is lightly pasted to locations 91 and along sidewalls 92 of the cone. The user can easily remove the tab 96 from the sidewalls 92 to which it is attached by gently pulling the tab 96. After the user has so removed the tab 96 from the sidewalls 92, the user can continue the movement and in the process remove the top region 49 of the cone from the rest of the cone.

It should be understood that the tab 96 can be made of any of various materials and can be replaced with a yarn, thread, string, etc., for the portion which is pasted to the sidewalls 92 of the cone. The string or thread may be made of a material chosen from paper, plastic, tin foil, metal, fiber or a combination thereof. In addition, the tab can be attached, pasted to or wrapped around the sidewalls of the dispenser in any of many different ways.

Figure 5:
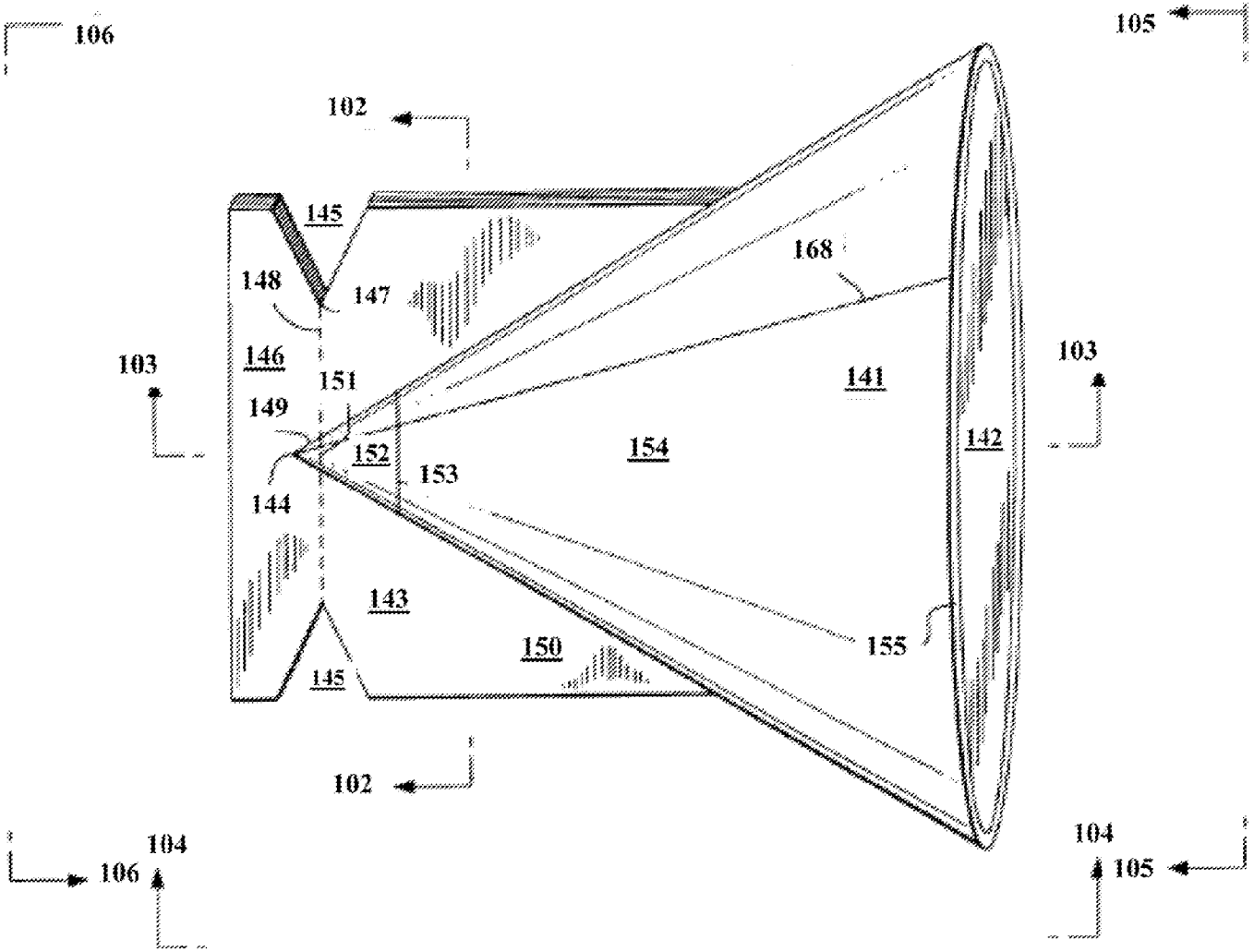
FIG. 5 shows an exemplary embodiment of a container in a horizontal position.

FIG. 5 shows a container in a horizontal position and including the following components thereof: sidewalls 141 of the cone, back (or base) 142 of the cone and tab 143. Both the back (or base) 142 of the cone and the sidewalls 141 can be made of collapsible, waterproof material such as plastic or tin foil. The tab 143 can be made of a material that maintains the shape and stiffness of the cone even when the volume of the substance contained in the container decreases. Another function of the tab is to facilitate the opening of the container at the tip of the cone.

The tab shown in FIG. 5 features notches 145 at respective sides of the tab 143. The user of the container can choose either side of the tab to start tearing off the top region 146 of the tab 143 starting at the inner tip 147 of either notch 145 and continuing along a perforated or indented scoreline 148 which runs from one side of the tab to the other and intersects with the top region 149 of the cone. The tab 143 can include thicker region 150 below the scoreline 148 and a less rigid, thinner region 146 above the scoreline. The less rigid, thinner upper region 146 of the tab makes it easier for the user of the container to tear off that portion of the tab to open the container while the thicker lower region of the tab maintains the conical shape of the container, even after it has been opened, and regardless of how much substance has been dispensed and left the cone. To start tearing off the upper region 146 of the tab, the user of the container may hold the container by keeping the lower part of the tab between index and thumb of one hand, and the upper part of the tab between index and thumb of the other hand, and start moving the two hands in opposite directions creating the most pressure at the inner tip 147 of the notch 145 that is located at the side of the tab where the user is holding the container. As the pressure builds, the tab will start tearing apart at such inner tip.

The collapsible walls 141 of the cone can be made of a plurality of different materials creating respective separate regions in the walls of the cone. Top region 149 of the cone runs from the tip 144 of the cone until an upper dividing line 151. Middle region 152 of the cone runs from the upper dividing line 151 until a lower dividing line 153, which is located between the upper dividing line 151 and border 155 where the back 142 (which is circular in the exemplary embodiment of FIG. 5) of the cone is attached to the sidewalls of the cone 141. Lower region 154 of the cone runs from the lower dividing line 153 to the border 155 (which is circular in the exemplary embodiment of FIG. 5).

The upper dividing line 151 is in line with the perforated or indented scoreline 148 in the tab 143. When the user of the container has torn off part of the upper region of the tab starting at the inner tip 147 of either notch 145 and continuing along the perforated or indented scoreline 148 until reaching the upper dividing line 151 in the top region 149 of the cone, the user can continue his tearing movement along the dividing line 151 to also tear off the top region 149 of the cone, and even the other side of the tab along the dividing line on the other side. In order to facilitate the continuation of the tearing movement of the user and the removal of the upper region of the cone, the dividing line 151 is slightly indented. Also, the top region 149 of the cone is more strongly attached to the upper region 146 of the tab than to the middle region 152 of the cone in order to ensure that the tearing off of the top region 149 would more naturally engender the tearing off of the upper region 146 of the tab when the user continues the tearing movement when it reaches the dividing line 151.

Figure 7:
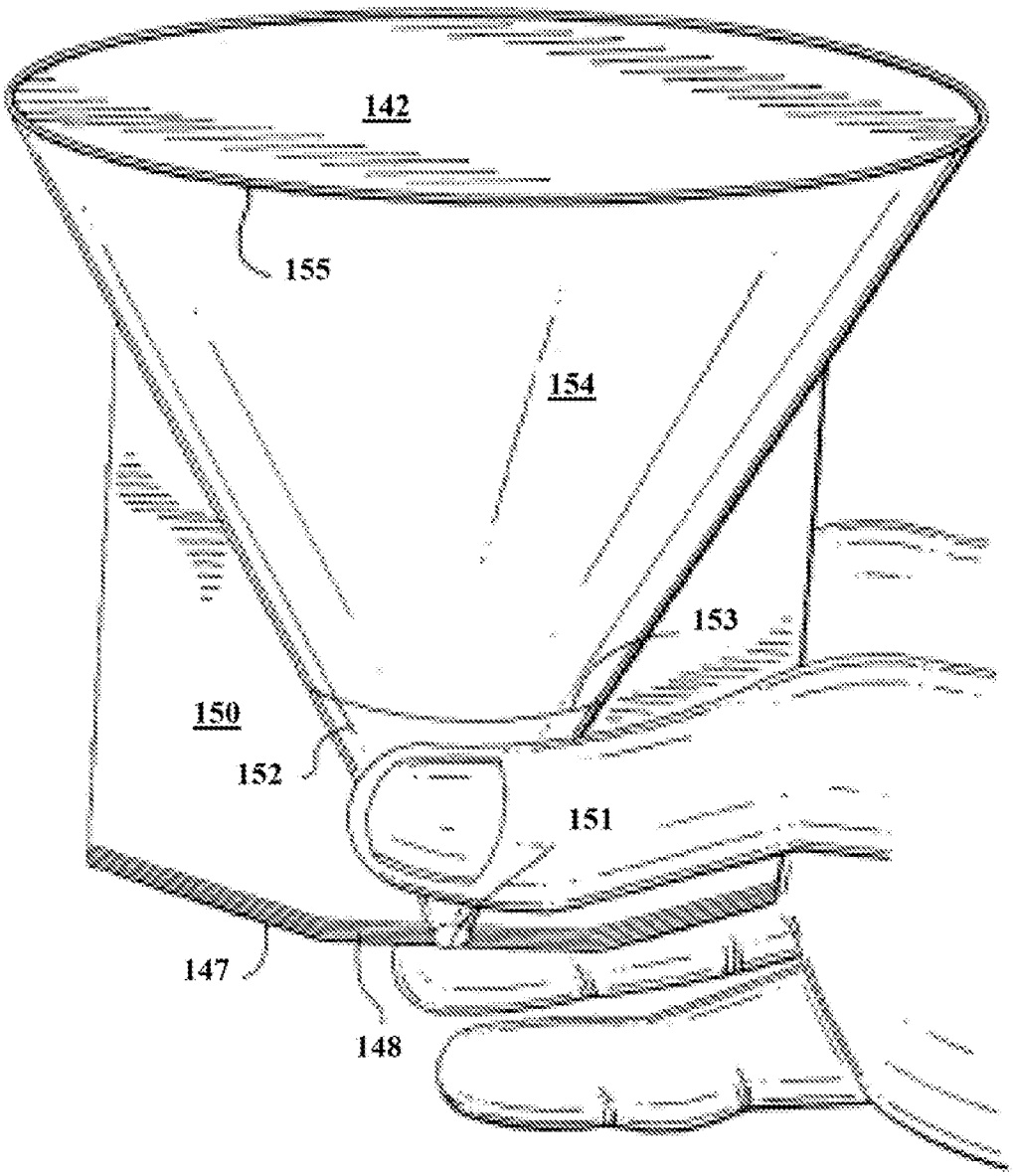
FIG. 7 shows a view of another exemplary embodiment of a container, after the container has been opened.

When the user has removed the top region 149 of the cone and the upper region 146 of the tab, the user is left with the extra rigid, thicker region 150 of the tab and the lower region 154 of the cone, and the user has effectively and easily opened a passageway for the substance to leave the container at the new tip of the container which is the remaining part of the dividing line 151. FIG. 7 shows the container after the top region 149 of the cone and the upper region 146 of the tab have been removed. The user can now dispense the substance of the cone in a precise manner by pointing the new tip 151 of the container to the spot where the substance is to be dispensed. Also, the user can now dispense the substance of the cone in a measured manner by more or less pressing the collapsible walls of the middle region 152 or the lower region 154 or the back 142 of the cone.

The middle region 152 of the collapsible walls of the container can be made of tin foil. After the user has opened the container, in the manner described above, and has used it to dispense some of the substance of the cone, there will be spare space available within the container. The user will be able to use this spare space to press the walls of the middle region 152 against each other, particularly at or near the new tip 151 of the container, where the cone is not as wide yet. By pressing the walls of the middle region in tin foil, the user will in effect be able to re-seal the container as it will close off the tip of the cone hermetically. The sealing effect may also be achieved by materials other than tin foil. Once the cone is resealed, the user can store the cone for use at a later time while keeping the substance of the cone in good condition.

Figure 6B:
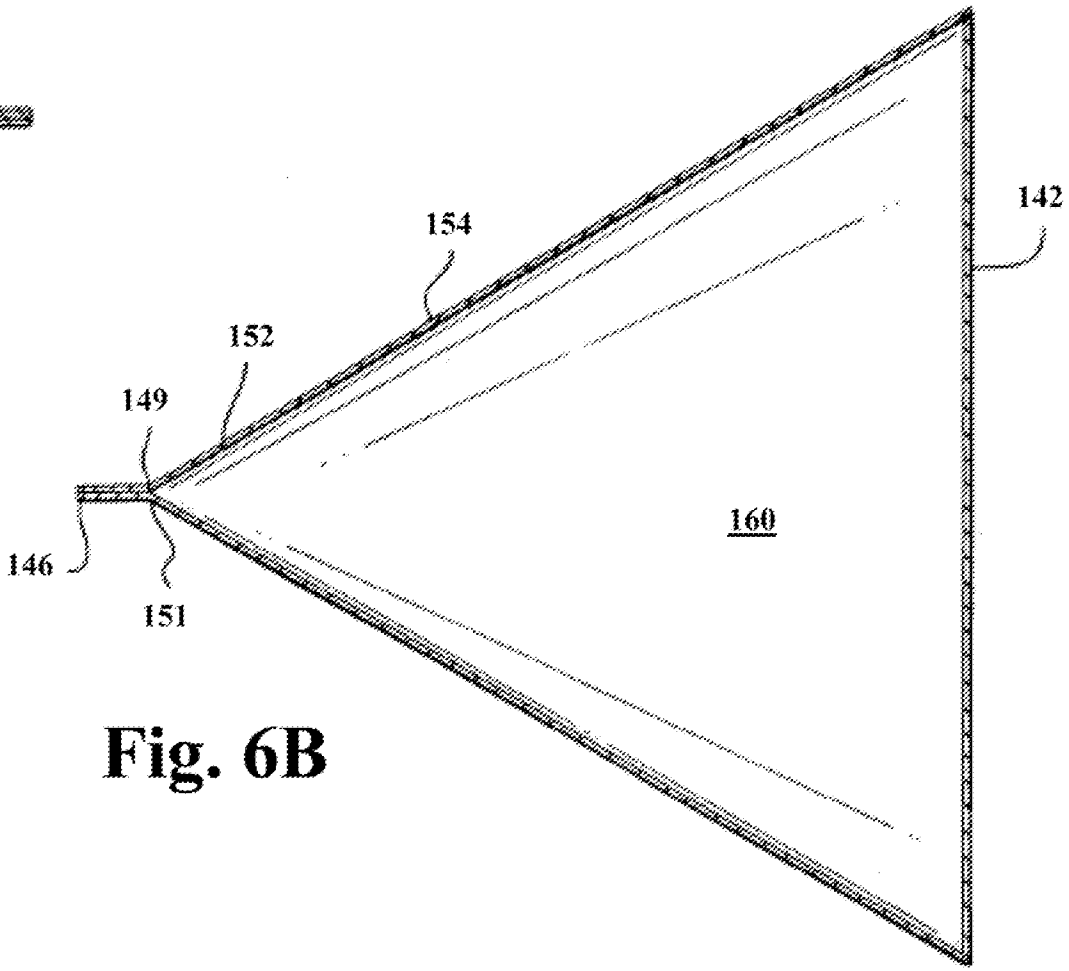
FIG. 6B shows a longitudinal cross section of the exemplary embodiment of FIG. 5 taken approximately along the line 103-103 of FIG. 5.
Figure 6A:
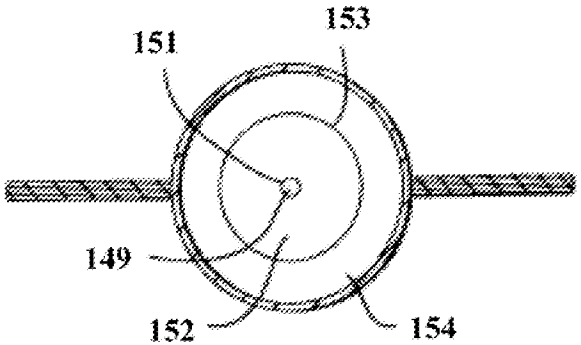
FIG. 6A shows a transverse sectional view of the exemplary embodiment of FIG. 5 taken approximately along the line 102-102 of FIG. 5.

FIG. 6A shows a transverse sectional view of the container taken approximately along the line 102-102 of FIG. 5 showing the top region 149, the middle region 152 and part of the lower region 154 of the cone, and the upper dividing line 151 and the lower dividing line 153 from the inside. FIG. 6A also shows part of the thicker region 150 of the tab 143 below the scoreline 148.

FIG. 6B shows a longitudinal cross section of the container taken approximately along the line 103-103 of FIG. 5 showing the top region 149, the middle region 152 and the lower region 154 of the cone, and the upper region 146 of the tab. FIG. 6B also shows half of the chamber 160 within the collapsible walls of the cone where the substance to be dispensed will be maintained before being dispensed.

Figure 8:
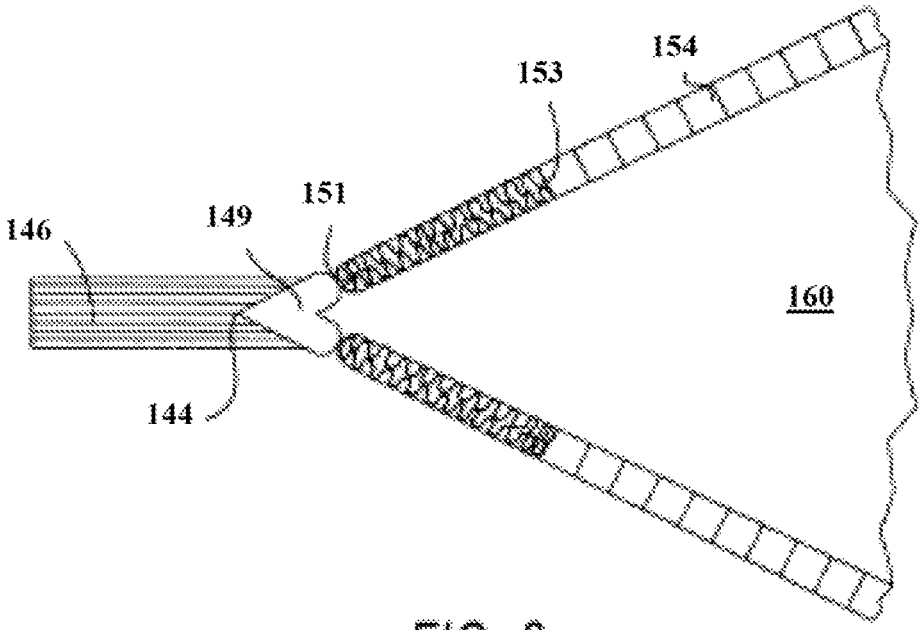
FIG. 8 shows a partial expanded view of the cross-sectional view of the embodiment of FIG. 6B.

FIG. 8 shows an expanded view of part of the cross-sectional view of FIG. 6B. FIG. 8 shows the upper region 146 of the tab, the top region 149, the middle region 152 and part of the lower region 154 of the cone, and part of the chamber 160 within the collapsible walls of the cone. FIG. 8 also shows more clearly the indentation at the upper dividing line 151, which allows the user of the cone to more easily tear off the top region 149 of the cone. Other embodiments of the container could provide for more or less indentation, or for other features facilitating the tearing off of the top region 149, at the dividing line 151 in order to optimize the functionality and user-friendliness of the container.

Figure 9:
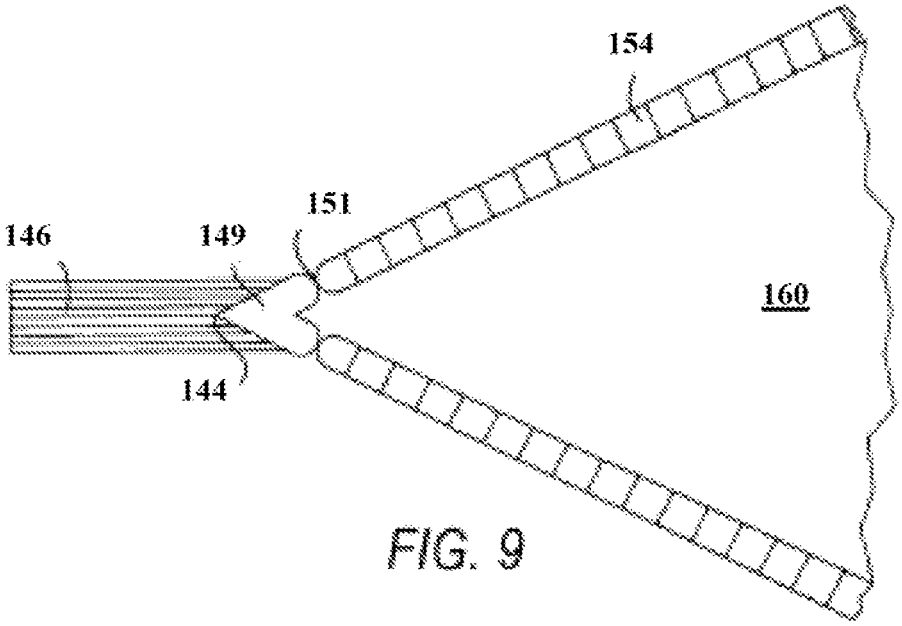
FIG. 9 shows a partial expanded view of a cross-sectional view of another exemplary embodiment of a container.

FIG. 9 shows an expanded view of part of a cross-sectional view of another exemplary embodiment where the container is otherwise as shown in FIGS. 5, 6B and 8, with the exception that there is no middle region 152 of the cone. Instead, the collapsible walls 141 of the cone are made of only two separate regions in the walls of the cone: first, the top region 149 of the cone which runs from the tip 144 of the cone until the upper dividing line 151, and second, the lower region 154 of the cone which runs from the upper dividing line 151 to the circular border 155. In this exemplary embodiment, the lower region 154 of the cone may be made of tin foil or a material with similar characteristics, like the middle region 152 in the exemplary embodiment as described in FIG. 8, thereby also granting to this embodiment the feature of re-sealability to the lower region 154 of the cone.

FIG. 6C shows a perpendicular view of the container taken approximately along the line 104-104 of FIG. 5 showing the top region 149, the middle region 152, and the lower region 154 of the cone, the upper dividing line 151 and the lower dividing line 153, the circular border 155, the thicker lower region 150 of the tab, and the less rigid, thinner upper region 146 of the tab, and the notch 145 that is visible on this side of the container.

FIG. 6D shows a frontal view of the back 142 of the cone taken approximately along the line 105-105 of FIG. 5. The back 142 of the cone, in the exemplary embodiment of FIG. 6D, is circular and flat and is attached to the sidewalls 141 of the cone at the circular border 155.

Figure 6E:
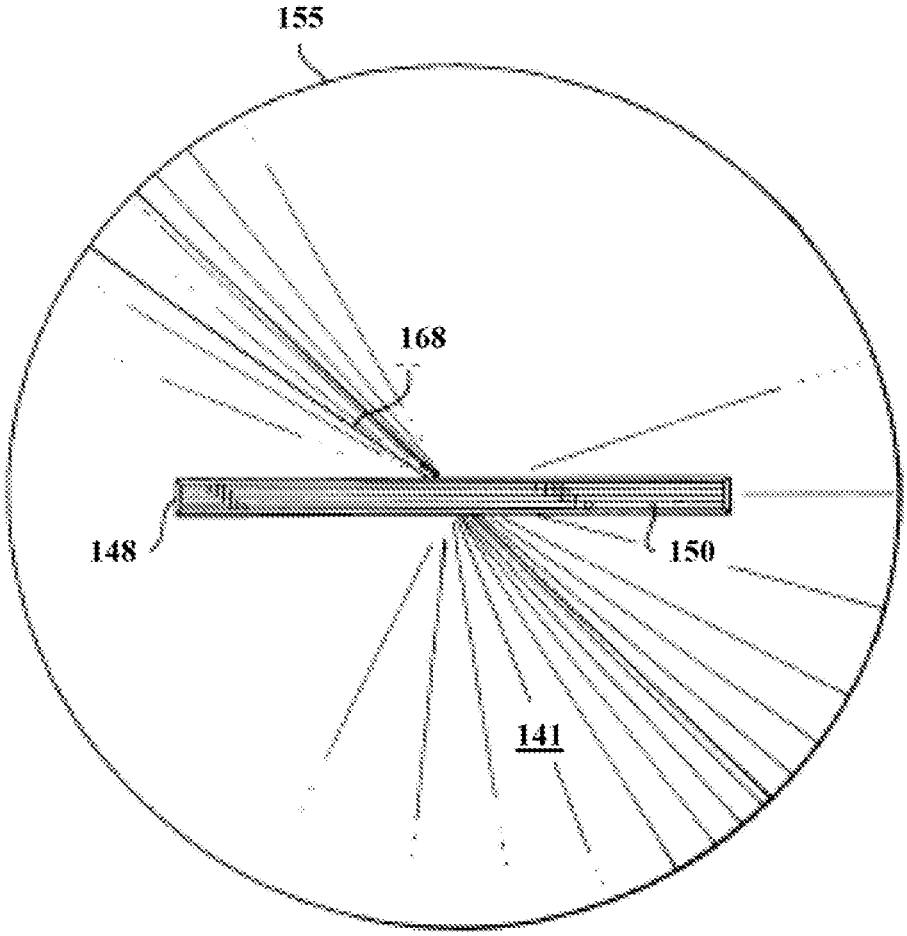
FIG. 6E shows a frontal view of the exemplary embodiment of FIG. 5 taken approximately along the line 106-106 of FIG. 5.

FIG. 6E shows a frontal view of the cone taken approximately along the line 106-106 of FIG. 5 showing the less rigid, thinner upper region 146 of the tab and the lower region 150 of the tab, which sticks out because it is thicker than the upper region 146. FIG. 6E also shows the sidewalls 141 of the cone, which are gradually wider the closer they are to the circular border 155 where they are attached to the back 142 of the cone, and conversely are gradually narrower the closer they are to the tip 144 of the cone which is enclosed in the upper region 146 of the tab.

Figure 10:
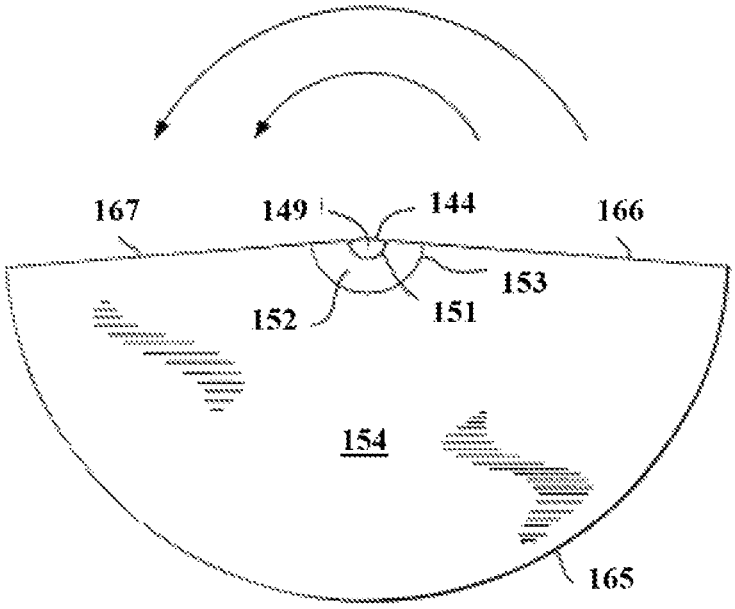
FIG. 10 shows an exemplary embodiment of a sheet used to manufacture a container.

Manufacturing of the sidewalls 141 of a conical shaped container, in an exemplary embodiment, can involve folding of a sheet of flexible material in the shape as shown in FIG. 10, in which one side 166 of the sheet is joined together with the other side 167 of the sheet creating a chamber in conical form where 144 is the tip of the chamber and the remaining side 165 of the sheet is at the bottom of the chamber. The joining of the two sides 166 and 167 creates a side seam 168 which will be visible, such as shown in FIGS. 5 and 6E. The remaining side 165 of the sheet is attached to the back (or base) 142 of the cone, thereby forming the circular border 155, which constitutes the circumference of the bottom of the container, as shown in FIGS. 5 and 7. As shown in FIG. 10, the sheet to constitute the sidewalls 141 of the container can be comprised of three regions corresponding to top region 149, middle region 152, and lower region 154, divided by the upper dividing line 151 and the lower dividing line 153. As described above, the upper dividing line 151 is slightly indented to allow the user of the container to more easily tear off the top region 149.

Figure 11:
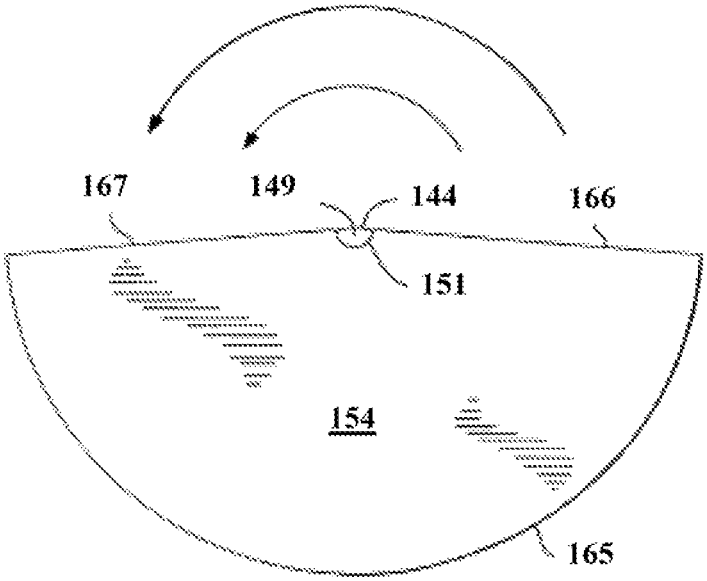
FIG. 11 shows another exemplary embodiment of a sheet used to manufacture a container.

FIG. 11 illustrates a sheet, similar to FIG. 10, for creating the sidewalls 141 of the container, except that there is no middle region 152 in the exemplary embodiment shown in FIG. 11. The sheet of FIG. 11 is used for creating only two separate regions in the walls of the cone, that is, the top region 149 and the lower region 154 of the cone, divided by the upper dividing line 151.

Figure 12:
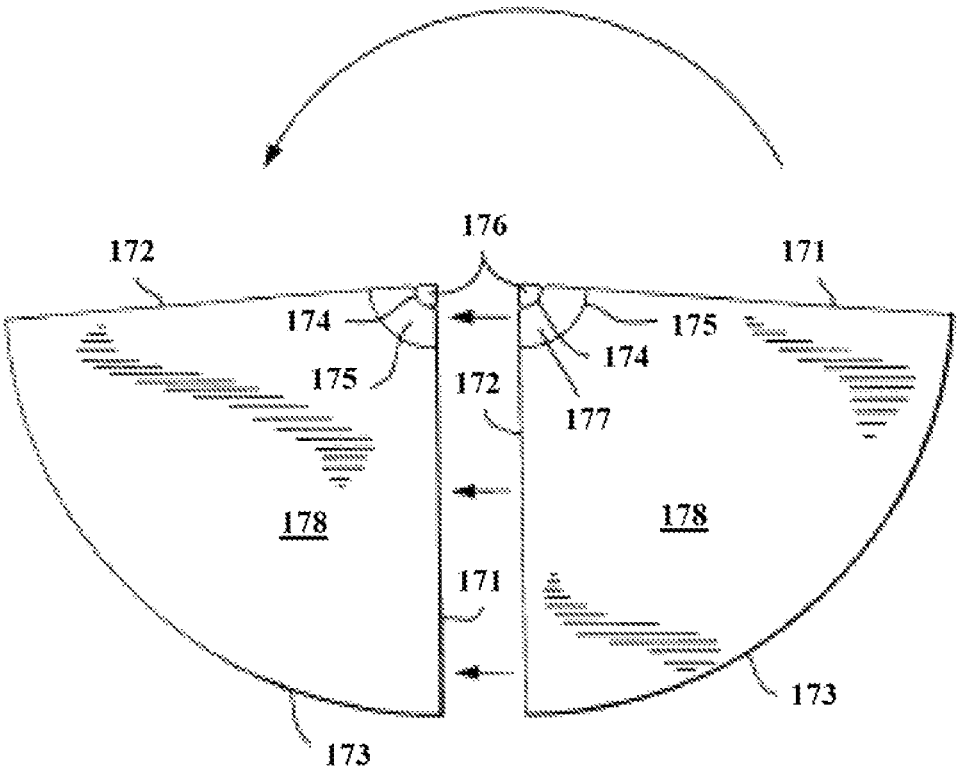
FIG. 12 shows an exemplary embodiment of two sheets used to manufacture a container.
Figure 21:
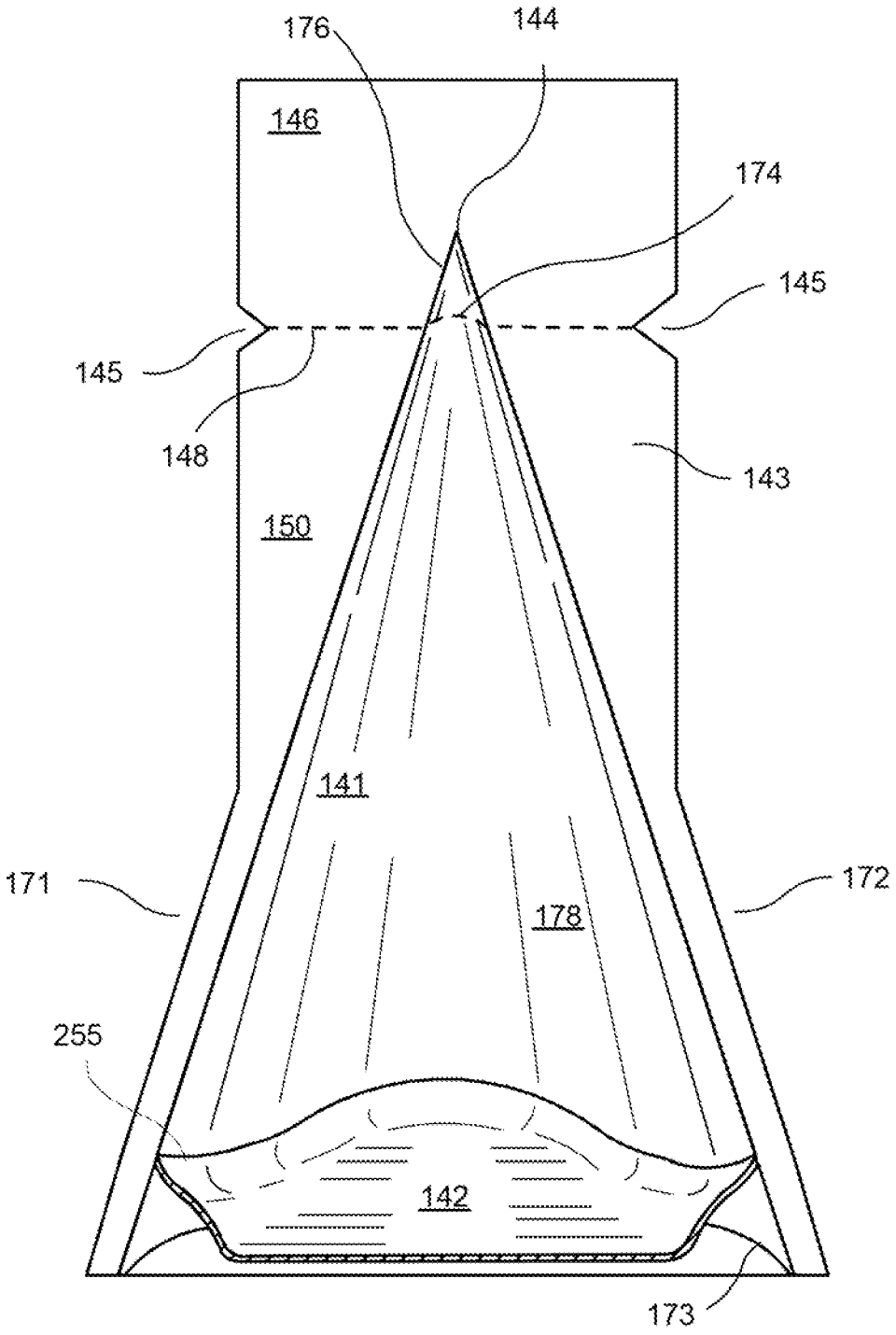
FIG. 21 shows a cross-sectional view of a container, in accordance with another exemplary embodiment.
Figure 22:
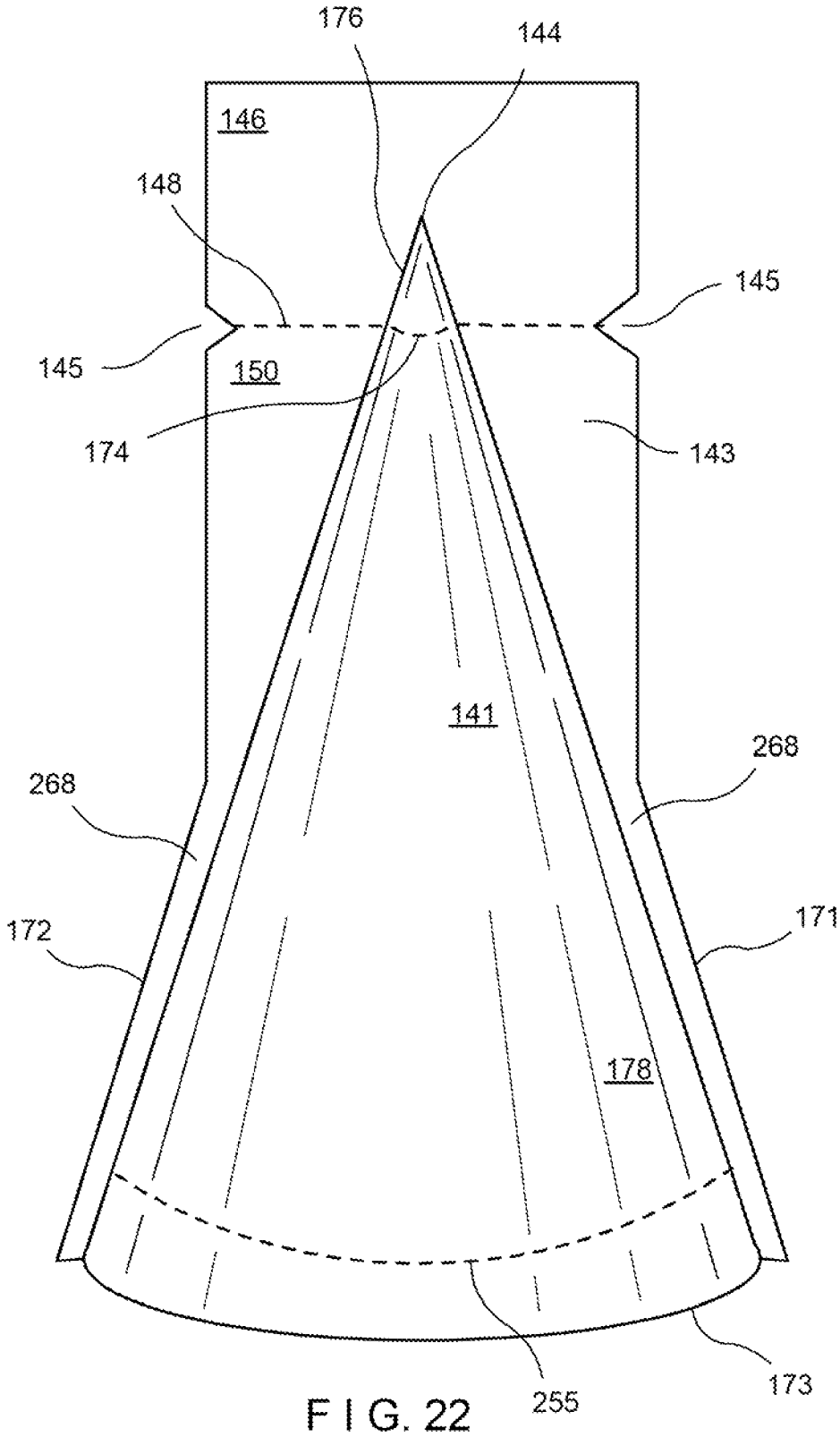
FIG. 22 shows a perspective view of the container of FIG. 21.
Figure 23:
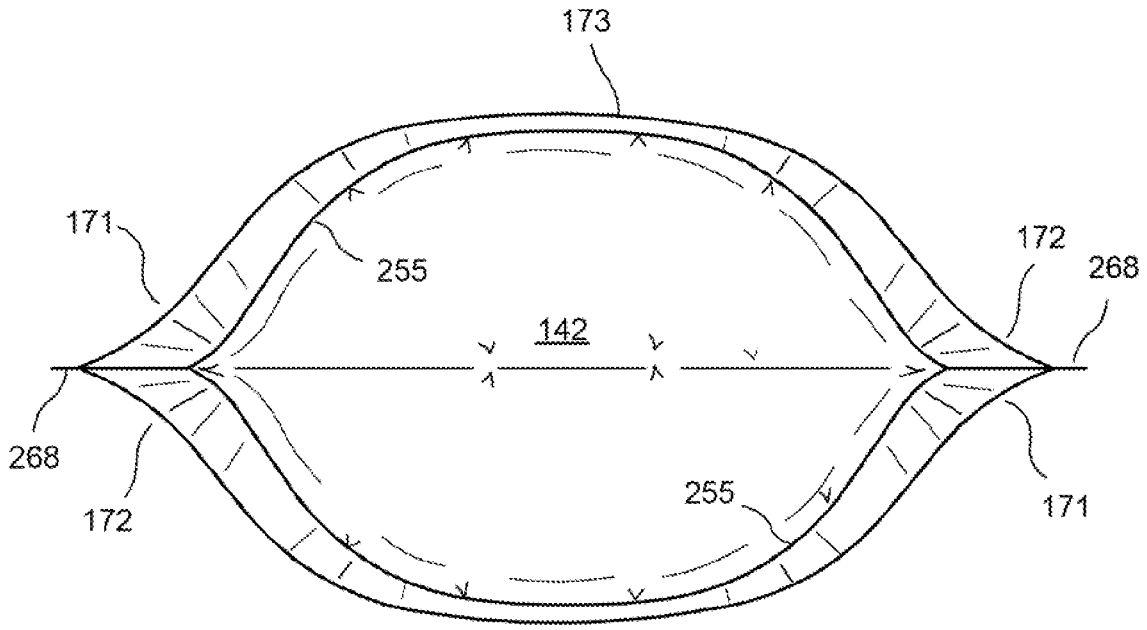
FIG. 23 shows a bottom view of the container of FIG. 21.

The sidewalls 141 of the container could also be manufactured using two substantially identical (or complementary) sheets of flexible material of a shape such as shown in FIG. 12, rather than folding a sheet as described above. In the exemplary embodiment of FIG. 12, the sides 171 and 172 of one sheet are joined with sides 172 and 171 of the other sheet, to create a chamber in conical form similar to the exemplary embodiments described above. Similar to the joining of the two sides 166 and 167 creating a side seam 168, as described above, the joining of the two sides 171 and 172 of one sheet with the two sides 171 and 172 of the other sheet, creates, in each case, a side seam 268, which is external to the main body, such as shown in FIGS. 22 and 23. The remaining sides 173 of the two sheets in FIG. 12 are similar to the remaining side 165 of FIG. 10, to be attached to the back 142 of the cone, thereby forming bottom seam 255, as shown in FIGS. 21-23. The joined top regions 176 of the sheet in FIG. 12 are similar to the top region 149 of FIG. 10; the joined middle regions 177 of the sheet in FIG. 12 are similar to the middle region 152 of FIG. 10; the joined lower regions 178 of the sheet in FIG. 12 are similar to the lower region 154 of FIG. 10; the joined upper dividing lines 174 of the sheet in FIG. 12 are similar to the upper dividing line 151 of FIG. 10; the joined lower dividing lines 175 of the sheet in FIG. 12 are similar to the lower dividing line 153 of FIG. 10. Similar to the embodiment described in FIG. 10, the upper dividing lines 174 are slightly indented to allow the user of the container to tear off the joined top regions 176 more easily. Alternative processes can of course be used to manufacture the sidewalls in conical shape where one or more sideseams, or no sideseams at all, will be visible when the container is assembled. As described further below, FIGS. 21-23 show an exemplary embodiment of a container in which the sidewalls 141 of the container are manufactured using two substantially identical (or complementary) sheets of flexible material of a shape such as shown in FIG. 12.

Figure 13:
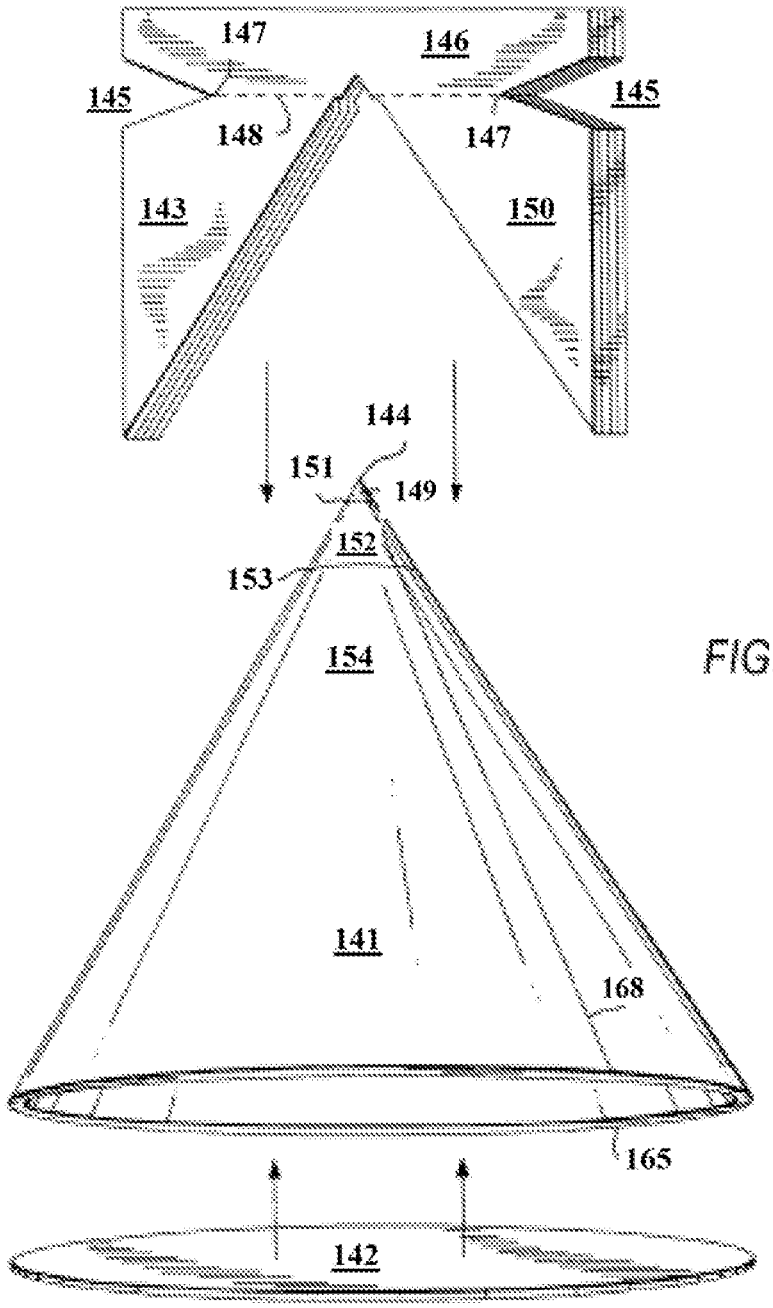
FIG. 13 shows how an exemplary embodiment of a container is assembled.

FIG. 13 shows how the sidewalls 141, the back 142 of the cone and the tab 143 can be assembled to construct the container. The tab 143 is attached to the sidewalls 141 of the cone so that the tab sits in the middle of the cone enclosing the tip 144 of the cone within the tab. The back 142 of the cone is circular in shape, in the exemplary embodiment of FIG. 13, and is attached to the sidewalls 141 of the cone. FIG. 13 also shows the top region 149, the middle region 152, and the lower region 154, the upper dividing line 151 and the lower dividing line 153 separating the regions of the cone, the side seam 168 of the cone, the lower side 165 of the walls which will be attached to the back 142 of the cone, the two regions of the tab 143 (the thicker region 150 below the scoreline 148, and the less rigid, thinner region 146 above the scoreline 148) and the two notches 145 at both sides of the tab 143.

Manufacturing in an exemplary embodiment, can include the following steps. In one step, to form the container, a sheet as shown in FIG. 10 is folded to create the sidewalls of the cone 141. In a second step, the tab 143 is attached on top of the sidewalls, as shown in FIG. 13. The tab 143 might be manufactured in any of various ways, such as discussed exemplarily below. In a third step, the container is filled with fluid or semi-fluid substance to be contained and dispensed. In another step, the back 142 of the cone is attached to the sidewalls. As an example of an alternative sequence, the back 142 of the cone may be sealed partially. During filling the non-sealed part of the bottom seam may be opened to allow filling, for example, by means of a separator with suction cups. The remainder of the seam is then sealed.

It should be apparent to those skilled in the art that alternative processes and manufacturing procedures may become apparent which enable the assembly of the container as shown in FIG. 5. Also, it should be evident that sheets in different shapes might be used to manufacture the container in a more economical or efficient manner, or that the shape of the sheets as described above may be slightly adjusted or cut to facilitate the welding, gluing or attaching of the various components of the container. In addition, it should be understood that there are a variety of materials by which the various regions and parts of the invention can be welded, glued (for example, using polymer or other substances), or otherwise attached to each other, and that there are a variety of different methods and procedures by which such welding, gluing or attaching may be realized.

FIGS. 14, 15, 16, 17, 18 and 19 show different exemplary embodiments of the tab 143 before it has been attached to the sidewalls 141. In FIG. 14, the upper region 146 of the tab is longer in length than in FIG. 5. Such exemplary embodiment has the advantage that the user of the container has more grip on the upper region and therefore can more easily tear off that region to open the container. FIG. 15 shows a side view of the tab 143 taken approximately along the line 115-115 of FIG. 14 showing the great difference in width between the extra rigid and thicker lower region 150 and the less rigid, thinner upper region 146. FIG. 15 also shows how there is a transition section 180 from the lower, thicker region 150 to the upper, thinner region 146 at the lower part of the notch 145.

Figure 16:
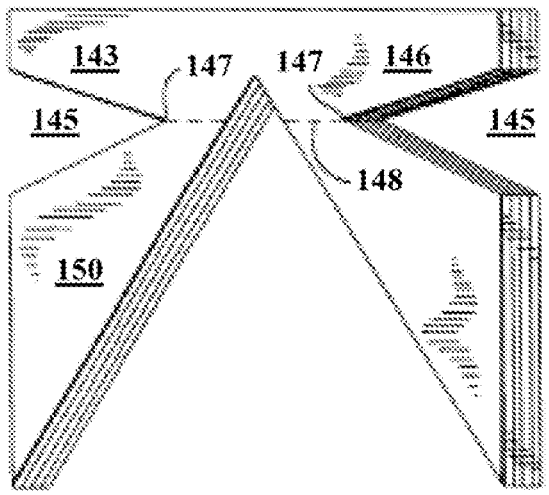

FIG. 16 shows an exemplar embodiment of the tab where the notch 145 goes much deeper into the tab 143 so that the inner tip 147 of either notch 145 is located much nearer to the area where the tip of the cone will be located. In such embodiment, the perforated or indented scoreline 148 is also shorter so that the user of the container can apply less effort to remove the upper region 146 of the tab and the upper region 149 of the cone.

Figure 17:
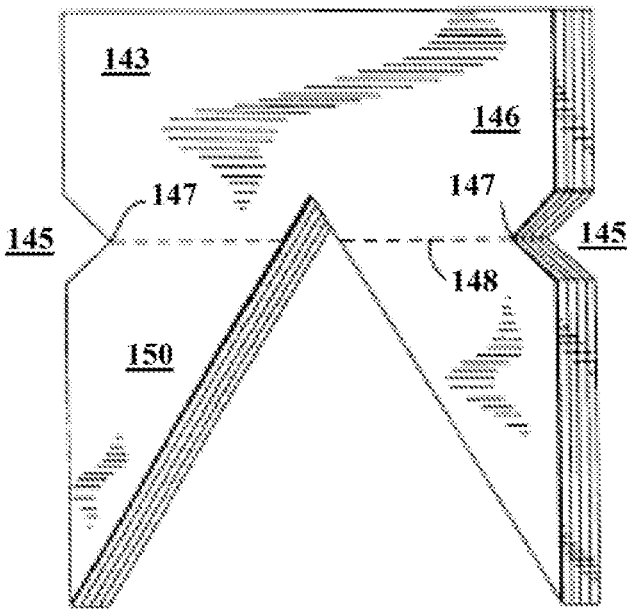

FIG. 17 shows another exemplary embodiment of the tab where the upper region 146 of the tab is longer in length than in FIG. 5 and where the notch 145 does not go as deep into to the tab 143 so that the inner tip 147 of either notch 145 is located further away from the area where the tip of the cone will be located. In such embodiment, the perforated or indented scoreline 148 is also longer. In addition, the lower region 150 and the upper region 146 of the tab in FIG. 17 have the same or similar thickness.

Figure 18:
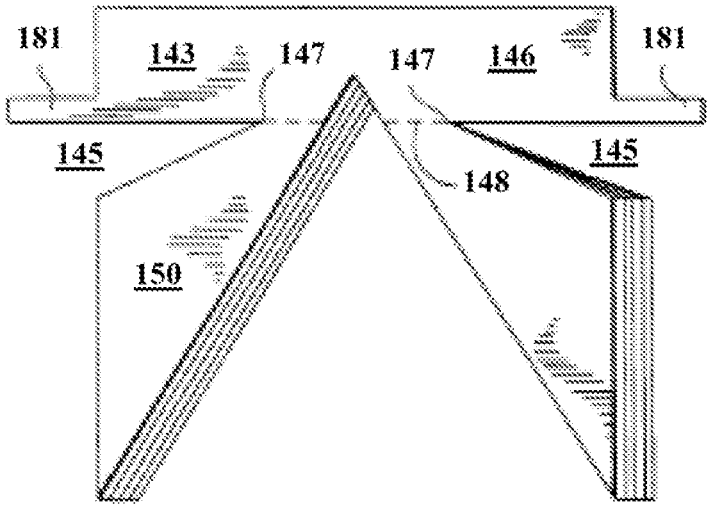

FIG. 18 shows yet another exemplary embodiment of the tab where upper region 146 of the tab features an additional stub 181 right above the two notches 145. The additional stub 181 may be an integrated part of, and therefore made of the same material as, the upper region 146 or may be made of material that is even more flexible and thin than the rest of the upper region 146.

Figure 19:
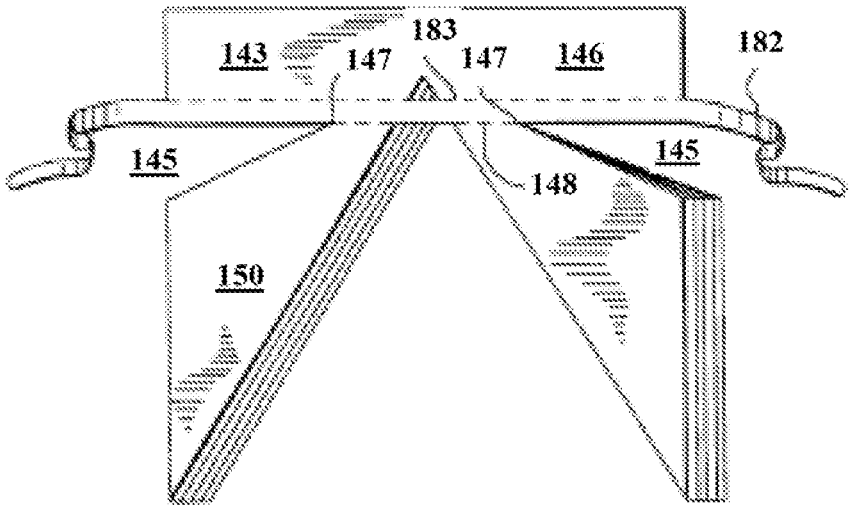

FIG. 19 shows an exemplary embodiment of the tab where a yarn or thread 182 is incorporated into the upper region 146 right above the perforated or indented scoreline 148. An additional perforated scoreline 183 is made right above the yarn or thread 182. The user of the container who wants to open the container can remove the upper region 146 of the tab and the top region 149 of the cone in a simple manner by pulling the yarn or thread 182, part of which is hanging loose on the side of the tab at the height of the notch so that the user can easily grasp the yarn or thread 182. The yarn or thread may be made of a material such as paper, plastic, tin foil, metal, fiber, etc., or a combination thereof. Alternatively, the yarn or thread 182 may be made of the same or a similar material as the material of the upper region 146 of the tab. Also, rather than incorporating the yarn or thread 182 into the upper region 146, it may be attached on the upper region, either before the tab 143 is attached to the sidewalls 141 of the cone, or after.

Figure 20:
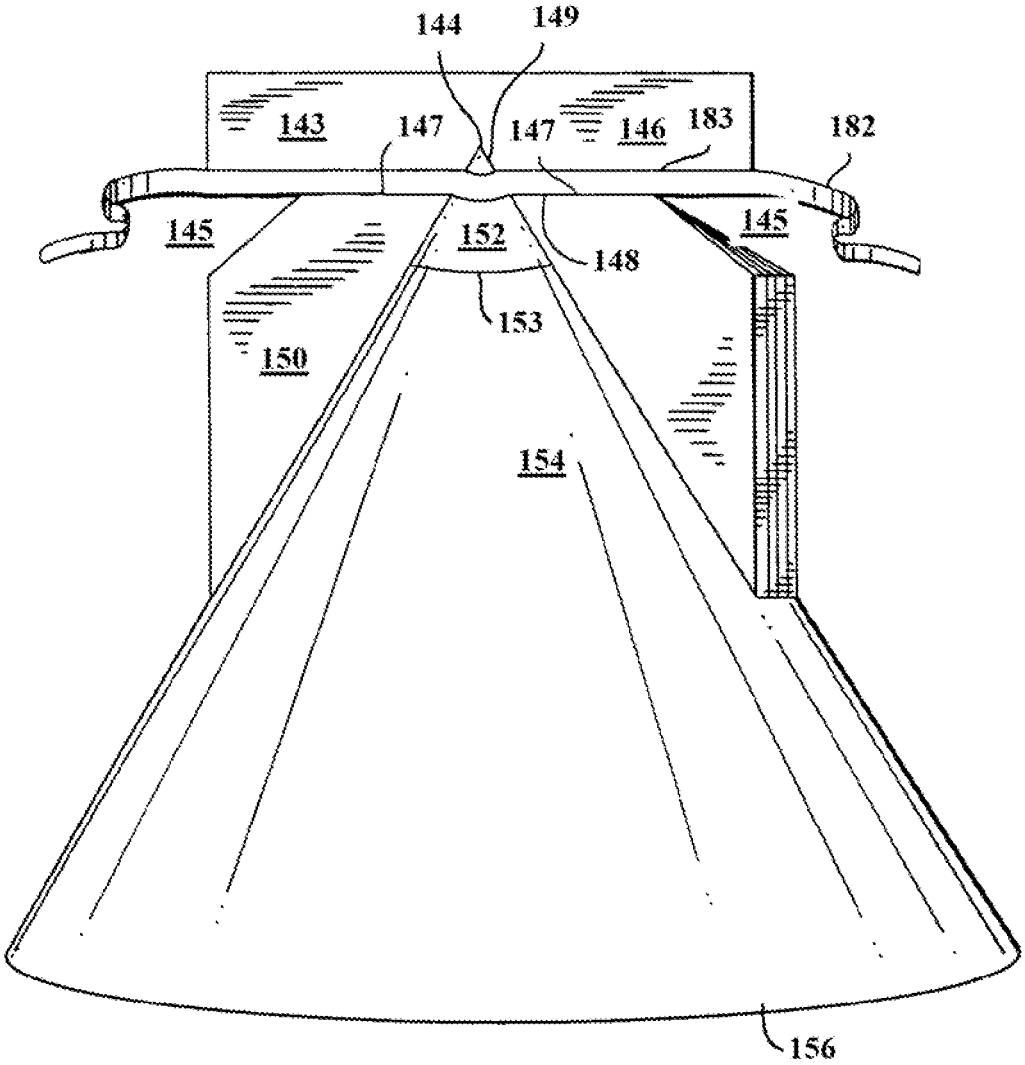
FIG. 20 shows an exemplary embodiment of a container incorporating the tab shown in FIG. 19.

FIG. 20 shows an exemplary embodiment in which a yarn or thread 182 is attached to the upper region 146 as described above in reference to FIG. 19. In addition to being aligned between the perforated or indented scoreline 148 and the additional scoreline 183, the yarn or thread 182 is also wrapped around the top region 149 of the cone on one side of the tab. Alternatively, two yarns or threads may run parallel along the scorelines while one of the yarns or threads wraps around the top region 149 on one side of the tab, and the other yarn or thread wraps around the top region 149 on the other side of the tab.

FIG. 21 shows a cross-sectional view of an exemplary embodiment of an empty container showing the inside of one half of the collapsible sidewalls 141 of the conical main body and the inside of one half of the collapsible back 142 of the conical main body. In this embodiment, the collapsible sidewalls 141 are manufactured using two sheets of flexible material of a shape such as shown in FIG. 12, one sheet of which is essentially shown in FIG. 21, since FIG. 21 shows a cross-sectional view. FIG. 21 shows the two sides 171 and 172 of the sheet that are joined with the two sides of the other sheet creating a sideseam 268 on each side of the respective sheets, as shown in FIG. 22. While the view of the remaining side 173 is largely obstructed by the collapsible back 142, FIG. 21 shows how the collapsible back 142 is attached to the remaining side 173 forming the bottom seam 255, along an inner wall of the main body. FIG. 21 further shows the conical main body with two regions, analogous to the exemplary body of FIG. 11 above. The top region 176 and lower region 178 of the sheet, when joined with the top region and lower region of the other sheet, constitute a top region and lower region, respectively, similar to the top region 149 and lower region 154 of the conical main body, as shown in FIG. 5. The upper dividing line 174 of the sheet when joined with the upper dividing line of the other sheet constitutes an upper dividing line similar to the upper dividing line 151 shown in FIG. 5. FIG. 21 further shows the tab 143, composed of a top region 146 and a lower region 150, separated by a scoreline 148 in which notches 145 are made on each side, and enclosing the tip 144 of the conical main body.

FIG. 22 shows a perspective view including the sideseams 268 created by the joining of the two sides 171 and 172 of the two sheets. FIG. 22 further shows the remaining side 173 of one of the sheets which, when attached to the back 142 of the cone, forms the bottom seam 255 constituting the circumference of the bottom of the container. FIG. 22 also shows the lower region 178, the top region 176 and the upper dividing line 174 of one of the sheets, forming a part of the collapsible sidewalls 141 of the container. FIG. 22 further shows the tab 143, composed of a top region 146 and a lower region 150, separated by a scoreline 148 in which notches 145 are made on each side, and enclosing the tip 144 of the conical main body.

FIG. 23 shows a bottom view of the container composed of the collapsible back 142 and the bottom seam 255 formed by the attachment of the remaining sides 173 of both sheets to the back 142 of the cone, constituting the circumference of the bottom of the container. FIG. 23 further shows the sideseams 268 on each side of the respective sheets formed by joining sides 171 and 172 of the sheet with the respective complementary sides of the other sheet.

Methods for manufacturing and assembling a container and dispenser such as described herein are disclosed in commonly-owned International application no. PCT/US2005/002405, filed Jan. 25, 2005, and U.S. application Ser. No. 10/782,218, filed Feb. 19, 2004, now U.S. Pat. No. 7,073,692, issued Jul. 11, 2006 (the entire contents of each of which are incorporated herein by reference).

It should be understood by those skilled in the art that alternative processes and manufacturing procedures are possible for the assembly of the dispenser as shown in the figures described above. Further, sheets in different shapes might be used to manufacture the dispenser in a more economical or efficient manner, and the shape of the sheets may be slightly adjusted or cut to facilitate or accommodate the welding, gluing or attaching of the various components of the dispenser. In addition, any of a variety of materials (for example, polymer or other substances) can be used to enable the various regions and parts of the container and dispenser to be welded, glued or otherwise attached to each other, and that there are a variety of different methods and procedures by which such welding, gluing or attaching may be realized. Further, the dispenser and the tab can be manufactured in a wide range of sizes, lengths and widths, which may contain any of the features of the embodiments described above.

The present disclosure addresses the need for a dispenser as described supra. The dispenser can be used for a variety of fluid or semi-fluid substances including, but not limited to, any type of sauce (such as ketchup, mayonnaise, salad dressing, etc.) spreadable cheese, chocolate paste, coffee cream, other prepared foods, as well non-edible liquid or semi-liquid consumer products such as conditioner or shampoo, hair gels, liquid soap, toothpaste and other cosmetic products. The subject matter of this disclosure obviates the need for a tool or utensil to open the dispenser and is therefore suitable for instances where such a tool or utensil is excessively burdensome or not practical. The conical shape allows the user of the dispenser to apply the substance contained within the dispenser in a measured and precise manner, where they want it and in the volume they want it, in a very easy and convenient manner. Because the dispenser is re-sealable, users of the dispenser can dispense the substance contained within at various times.

The conical-shaped container or dispenser of this disclosure can have many features, such as a tab attached to a top region of the conical main body where a zone of weakness exists at a dividing line between the top region and the rest of the main body to allow the user to easily tear off the tab and remove the top region of the main body, to open a passageway in the tip of the conical main body where the substance can exit the dispenser by pressing together the collapsible walls or back of the dispenser, without the need for a utensil. In addition, a middle region of the cone can be made from a foil-like material that makes the cone re-sealable by pressing the walls of the middle region against each other. Another optional feature is that a cap can be enclosed within the tab which allows the user to open or close the dispenser by removing or pressing the cap on the top region of the cone.

While some containers in the marketplace are squeezable (for example, tubes for toothpaste, sachets for ketchup, etc.), the container or dispenser of this disclosure embodies a combination of advantageous features that contribute to user experience of convenience and control that is uniquely available to such container or dispenser. After easily tearing the tab and opening the container, the user is in complete control to dispense the content in a measured and precise manner by more or less pressing the collapsible walls and back of the container and by pointing the tip of the conical main body to the spot where the content should be applied. The fact that the back is collapsible allows the user to push the content forward towards to the tip of the cone, completely emptying the container, if the user so desires, and avoiding waste of any content that may otherwise remain in the container or dispenser. The container or dispenser of this disclosure can be manufactured in a variety of ways, including, e.g., by blow molding the container including tab, conical main body and back in one piece. Another manner, which is preferable, is to have the back and the rest of the container as separate pieces, which are then joined together. In this manner, the user may take advantage of a back of the container that would be easier to manipulate, resulting in an enhanced level of user convenience and control.

In addition, the tab constitutes a component that is distinct from the conical main body. Other containers in the marketplace may provide for a notch on the side of the container where the user can start tearing to open the container. The tab in the container or dispenser of this disclosure, however, is not only a way to facilitate the initiation of the tearing process, but also provides room where the tearing process can gain speed by the time it reaches the conical main body, and the tearing speed can then be continued while tearing the conical main body. Such mechanism allows the container or dispenser to be more easily opened. Further, the tab provides additional structural support to maintain the shape and stiffness of the cone even when the volume of the substance contained within the container decreases.

What has been illustrated and described herein is an improvement in certain types of squeezable articles of manufacture such as fluid containers made of flexible material. While the improvements have been illustrated and described with reference to certain preferred embodiments, the present disclosure is not limited thereto. In particular, the foregoing specification and embodiments are intended to be illustrative and are not to be taken as limiting. Thus, alternatives, such as structural or mechanical equivalents, or alternative methodologies of manufacturing the subject matter of this disclosure, and other modifications will become apparent to those skilled in the art upon reading the foregoing description. Accordingly, such alternatives, changes, methodologies and modifications are to be considered as forming a part of the present disclosure insofar as they fall within the spirit and scope of the appended claims.

The examples described herein are primarily provided in the context of a conical dispenser made from flexible plastic material. Nevertheless, it should be understood that the disclosure also contemplates applications using other flexible waterproof material, not made of plastic. Also, the examples provided are primarily provided in the context of a dispenser for small portions of liquid or semi-liquid consumer goods. Nevertheless, it should be understood that the disclosure contemplates applications in any size, from very big to extra-small, and applications to containers outside the area of consumer goods, and for any substance, edible or non-edible. It should be understood that the added convenience and ease of use of the container or dispenser of this disclosure may also offer benefits for non-liquid substances such as powders or ice cream. In the case of ice cream or other iced substances, the user can suck the content from the container at the small opening in the tip of the container while manipulating the collapsible walls and back of the container. The above-mentioned applications are provided for illustrative purposes and are not intended to limit the scope of this disclosure and the appended claims.

The specific examples and exemplary embodiments described above are illustrative, and many variations can be introduced on these examples and embodiments without departing from the scope of the disclosure and the appended claims. For example, it should be understood that elements and/or features of different illustrative embodiments may be combined with each other and/or substituted for each other within the scope of this disclosure and appended claims.

What is claimed is:

1. A conical-shaped container comprising:

a conical main body formed of a collapsible material and including a collapsible back and one or more collapsible sidewalls; and a tab attached to the conical main body and configured to be torn, the tearing of the tab continuing until said tearing reaches the conical main body, whereupon continuing tearing movement separates a top region of the conical main body from a remaining portion of the conical main body, thereby opening the conical main body, wherein the tab is flexible, wherein said collapsible back and said one or more collapsible sidewalls are configured for contents of the conical main body to be dispensed by pressing the collapsible back and sidewalls of the conical main body, and wherein said conical main body includes a bottom seam formed by joining the collapsible back to the collapsible sidewalls.

2. The container as claimed in claim 1, wherein all, or the remaining portion, of the conical main body has a sealing property wherein said material is re-sealable by pressing said material.

3. The container as claimed in claim 1, wherein a remainder of the conical main body, other than the top region of the conical main body, includes a foil-like material so that the container is re-sealable by pressing the foil-like material together.

4. The conical-shaped container of claim 1, wherein a zone of weakness is created in the tab or the top region of the conical main body to facilitate a tearing of the tab or the top region of the conical main body from the remaining portion of the tab or the conical main body, thereby opening the conical main body.

5. The container as claimed in claim 4, wherein the zone of weakness in the tab or the top of the conical main body is created by a scoreline.

6. The container as claimed in claim 1, further comprising a thread attached to the tab or the top of the conical main body, to make easier a tearing of the tab or the top of the conical main body from the conical main body.

7. The container as claimed in claim 1, wherein the sidewalls join to form at least one side seam in a longitudinal direction from the back.

8. The container as claimed in claim 1, wherein said sidewalls have one or more sideseams from joining the sidewalls to each other.

9. The container as claimed in claim 1, wherein the conical main body and the tab are made of the same material.

10. The container as claimed in claim 1, wherein a notch is formed in the tab to facilitate a tearing of the tab and the top region of the conical main body from the conical main body, to open the conical main body.

11. The container as claimed in claim 1, wherein the top region of the conical main body is made of a different material than a remainder of the conical main body.

12. A conical-shaped container comprising:

a conical main body formed of a collapsible material; and a tab attached to the tip of the conical main body and configured to be torn from the conical main body, to open the conical main body, wherein a cap configured for resealing the container is enclosed in the tab, and wherein the tab is flexible.

13. The container as claimed in claim 12, wherein the conical main body includes a collapsible back and one or more collapsible sidewalls, and said collapsible back and said one or more collapsible sidewalls are configured for contents of the conical main body to be dispensed by pressing the collapsible back and sidewalls of the conical main body.

14. The container as claimed in claim 13, wherein said conical main body includes a bottom seam formed by joining the collapsible back to the collapsible sidewalls.

15. The container as claimed in claim 13, wherein the sidewalls join to form at least one side seam in a longitudinal direction from the back.

16. The container as claimed in claim 13, wherein said sidewalls have one or more sideseams from joining the sidewalls to each other.

17. The container as claimed in claim 12, where the conical main body and the tab are made of the same material.

18. The container as claimed in claim 12, wherein the top region of the conical main body is made of a different material than a remainder of the conical main body.

19. The conical-shaped container of claim 12, wherein a zone of weakness is created in the tab or the top region of the conical main body to facilitate a tearing of the tab or the top region of the conical main body from the remaining portion of the tab or the conical main body, thereby opening the conical main body.

20. The container as claimed in claim 19, wherein the zone of weakness in the tab or the top of the conical main body is created by a scoreline.

21. The container as claimed in claim 12, further comprising a thread attached to the tab or the top of the conical main body, to make easier a tearing of the tab or the top of the conical main body from the conical main body.

22. The container as claimed in claim 1, wherein a large portion of the tab is cut out close to, or up to, reaching the conical main body.

* * * * *